United States Patent [19]

Eynck

[11] 4,390,976

[45] Jun. 28, 1983

[54] ACOUSTIC SIGNAL CONDITIONING DEVICE

[75] Inventor: John J. Eynck, Arnold, Md.

[73] Assignee: The United States of America as represented by the Secretary of the Navy, Washington, D.C.

[21] Appl. No.: 228,847

[22] Filed: Jan. 27, 1981

[51] Int. Cl.[3] ..... H04R 17/00

[52] U.S. Cl. ..... 367/153; 310/337; 367/149; 367/151; 367/152; 367/162; 367/173; 367/176; 181/288

[58] Field of Search ..... 367/141, 149, 151, 152, 367/153, 155–157, 165, 167, 172, 173, 176, 162; 310/321, 326, 335, 337; 181/175, 286, 288, 290, 292; 248/559, 562

[56] References Cited

U.S. PATENT DOCUMENTS

| | | | |
|---|---|---|---|
| 2,754,925 | 7/1956 | Burke . | |
| 2,768,364 | 10/1956 | Camp | 367/155 |
| 3,087,574 | 4/1963 | Watters . | |
| 3,177,970 | 4/1965 | Boschi | 181/290 |
| 3,424,270 | 1/1969 | Hartman et al. | 181/290 |
| 3,601,228 | 8/1971 | Nashif . | |
| 3,737,004 | 6/1973 | Higgs . | |
| 3,907,062 | 9/1975 | Bugham | 367/151 |
| 4,177,876 | 12/1979 | Pujolle . | |

FOREIGN PATENT DOCUMENTS

| | | | |
|---|---|---|---|
| 359867 | 3/1962 | Switzerland | 181/292 |

*Primary Examiner*—Harold J. Tudor
*Attorney, Agent, or Firm*—R. F. Beers; L. A. Marsh

[57] ABSTRACT

An underwater acoustic array comprises an acoustic skirt baffle positioned adjacent to a hull surface for reducing the transmission of shipboard noise; an acoustic conditioning module positioned over the acoustic skirt baffle; and an outer layer secured to the acoustic conditioning module and containing a plurality of hydrophone units.

The acoustic conditioning module comprises inner and outer spaced coverplates; a plurality of spacer elements extending between the coverplates to form a plurality of closed chambers therebetween; and "tuned" viscoelastic damping elements secured to the outer coverplate.

6 Claims, 6 Drawing Figures

ACOUSTIC SIGNAL CONDITIONING DEVICE

BACKGROUND OF THE INVENTION

The present invention relates to signal enhancement systems and, more particularly, to acoustic arrays used on underwater surfaces.

Modern sonar arrays used on the exterior surfaces of submarine hulls often include a layer of acoustic isolation baffles positioned adjacent to the hull for reducing the radiation of shipboard noise. These arrays also include an outer layer containing a plurality of hydrophone units, and an intermediate sound conditioning layer secured to the isolation baffle for improving the quality of the incoming signals.

The acoustic isolation baffles attenuate, absorb and reflect shipboard noise by means which may include, for example, one or more layers of a composite material such as "Corprene", in which cork particles are embedded in a neoprene matrix; and gas and/or air filled multicellular materials such as foam rubbers. However, these types of sound dissipation means often share a common drawback in being pressure and frequency dependent. For example, the impedance of light materials such as cork and cellular substances changes as the materials are compressed so that the acoustic absorption efficiency is likewise changed.

The conditioning layer is used to provide a mass reactance which coherently reflects the incoming signals so that the reflected signals reinforce the incident acoustic signals. These conditioning layers normally include a "backing plate" of steel or some similar material which has an impedance higher than water and a thickness of about one-quarter of the wave length of the predominant, incident acoustic frequency in the backing plate material. At this thickness the hydrophones will have maximum efficiency and sensitivity for incoming acoustic signals of the preferred frequency. However, for comparatively low acoustic design frequencies, the requisite thickness and weight of the quater-wave thick plate can become prohibitive. For example, a quarter-wave steel plate for a design frequency of 2.4 KHz would have a thickness of about 52 cm. Thus at low frequencies the great weight and bulk of solid "backing plate" arrangements becomes prohibitive.

SUMMARY OF THE INVENTION

The abovementioned drawbacks with the prior art are overcome by providing a lightweight, compact hydrophone array capable of high efficiency over a broad range of depths and incident acoustic frequencies. This is accomplished by providing a multilayered hydrophone array which comprises an acoustic skirt baffle positioned adjacent to the hull; a "tuned" acoustic conditioning module supported over the skirt baffle; and a layer of hydrophones positioned adjacent to the conditioning module.

The "tuned" conditioning module comprises inner and outer spaced, planar coverplates designed to extend generally parallel with the hull surface; spacer elements extending between the coverplates to form a plurality of closed chambers therebetween; and tuned damping elements positioned in the chambers and secured to the outer coverplate. Preferably, the tuned damping elements include an elastomeric mass or damping layer, which is secured to the coverplate, and an inertial tuning mass, such as a flat plate, attached to the damping layer. The chambers are sealed from the surrounding environment so that the characteristic impedance and efficiency of the damping elements is independent of the hydrostatic pressure.

Accordingly, it is an object of this invention to provide an improved sonar array of a simple, efficient design which is inexpensive to construct and maintain.

Another object of the invention is to provide a compact, lightweight sonar array of sufficient strength and rigidity so that drag or other hydrodynamic forces do not appreciably deform or damage the array, but where the array retains the flexibility needed for mounting the array on curved surfaces.

A further object of this invention is to provide an underwater acoustic array which has high efficiency throughout broad ranges of incident acoustic frequencies and hydrostatic pressures.

Still another object of the invention is to provide a compact backing plate structure for sonar arrays which presents a high impedance to a prescribed range of incident acoustic frequencies for a wide range of hydrostatic pressures.

Yet another object of the invention is to provide new and improved, means for enhancing incident acoustic signals which weighs considerably less than "backing plates" heretofore available.

BRIEF DESCRIPTION OF THE DRAWINGS

The novel features which are believed to be characteristic of this invention are set forth with particularity in the appended claims. The invention itself, however, both as to its organization and the method disclosed herein, together with further objects and advantages thereof, may be best understood by reference to the following description taken in conjunction with the accompanying drawings, in which:

DETAILED DESCRIPTION OF THE INVENTION

Figure 1:
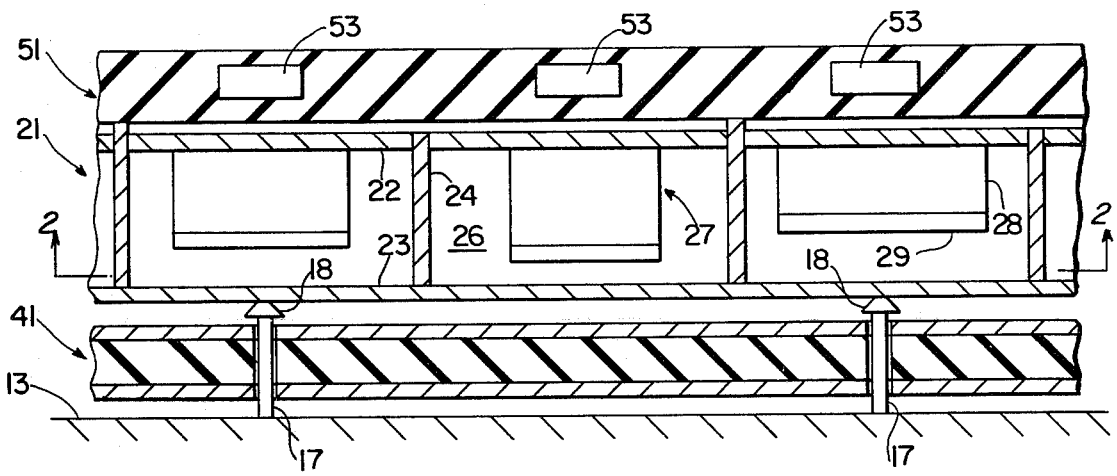
FIG. 1 is a sectional view of the sonar array of the present invention.

Referring now to FIG. 1 there is shown a multilayered sonar array 15 which includes an acoustic skirt baffle 41 positioned adjacent to the hull 13 of the vessel, an acoustic conditioning module 21 supported over the skirt baffel 41, and a layer of hydrophones 53 superimposed over the conditioning module in contiguous relationship therewith.

The conditioning module 21 provides a mass reactance which coherently reflects the incoming signals so that the reflected acoustic signals reinforce the incident acoustic signals. For example, when a planar beam of acoustic waves is reflected from an air "backed" conditioning module, a stationary system of waves is obtained which gives rise to pressure and velocity fields that are offset (out of phase) from each other by $\lambda/4$, where $\lambda$ is the wavelength of an acoustic signal. Thus, the stationary pressure waves have a nodal point or a minimum value at the interface surface of the air backed reflector and a maximum value at the surface of the conditioning module. In order to obtain maximum hydrophone sensitivity, the hydrophones 53 should be placed where the peak pressure field occurs. It follows that the sensitivity of hydrophones 53 positioned at a distance ($\lambda_1/4$) from a reflecting surface reaches a maximum value only at a predetermined frequency ($f_1$), where the velocity $V_1=\lambda_1 f_1$. The sensitivity decreases slightly as the frequency of the incoming acoustic signals deviates from the particular frequency $f_1$ by $\pm\frac{1}{3}$ octave. For narrow band hydrophones, such as those designed to receive signals of a predetermined center frequency, the loss in sensitivity is ordinarily not a problem.

The center frequency (fc) is defined as the mid-band, predominant frequency of a predetermined frequency range. Thus, for example, hydrophone units may have a particular center frequency with it being understood that the hydrophones will have optimum performance over a predetermined frequency band. Accordingly, the sensitivity and efficiency of hydrophone units is reduced where the hydrophones are expected to detect incident signals over a wide frequency band.

Figure 2:
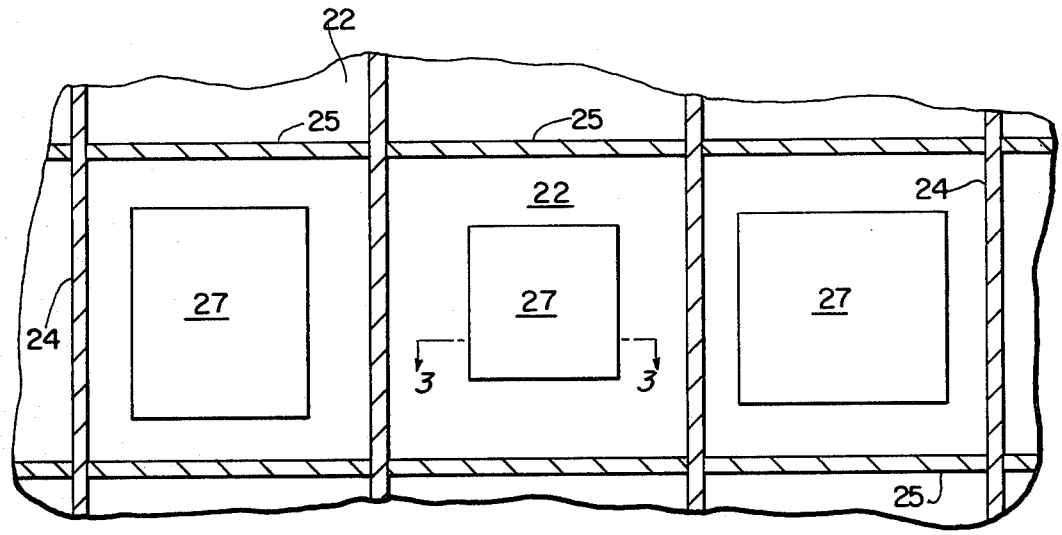
FIG. 2 is a view of the sonar array taken generally along line 2—2 of FIG. 1.
Figure 3:
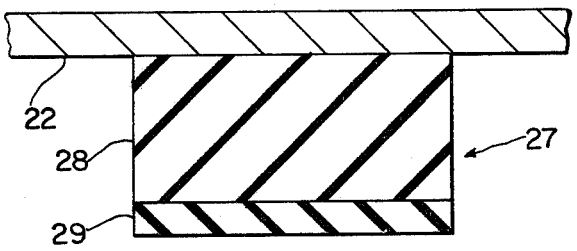
FIG. 3 is a cross-sectional view of the damping elements taken along line 3—3 of FIG. 2.
Figure 4:
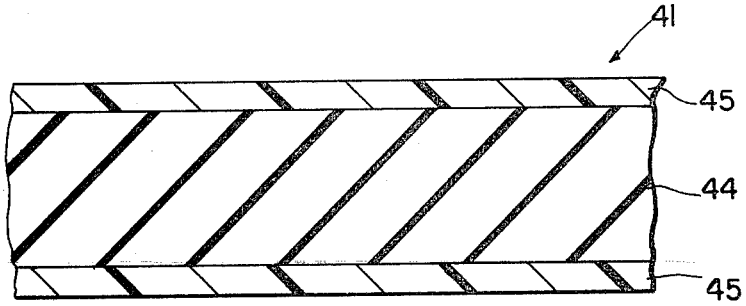
FIG. 4 is a sectional view of an acoustic skirt baffle.
Figure 5:
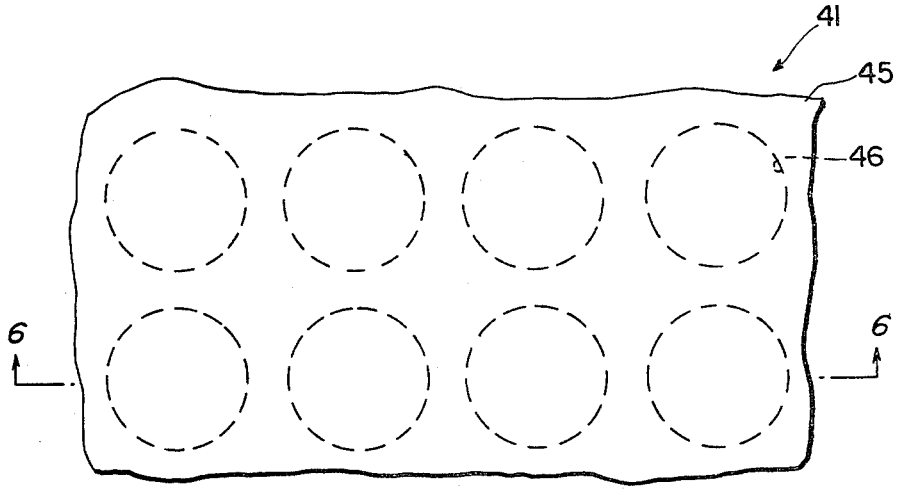
FIG. 5 is a plan view of another type of acoustic skirt baffle.
Figure 6:
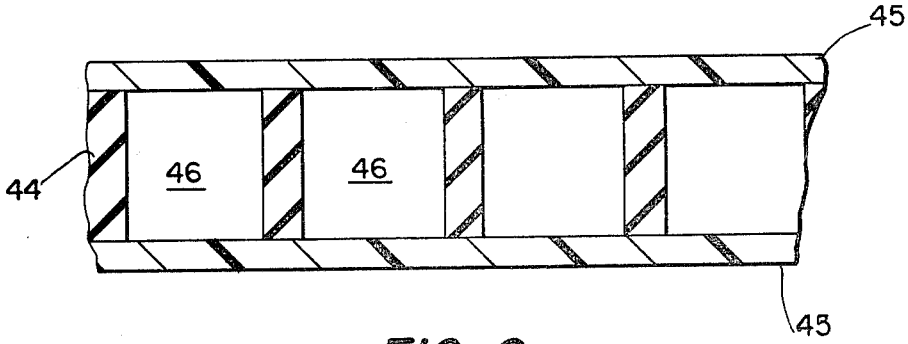
FIG. 6 is a sectional view of FIG. 5, taken generally along line 6—6.

The acoustic conditioning module 21 and skirt baffle 41 of the array 15 in FIG. 1 provide a means for efficiently detecting incident acoustic signals over a wide frequency range. This improved sensitivity and efficiency for a broad range of frequencies is accomplished by providing the acoustic module 21 with a plurality of tuned, viscoelastic damping elements 27, as more particularly illustrated in FIGS. 2 and 3, and by providing skirt baffle 41 with a plurality of air cells as shown in FIGS. 4, 5 and 6. The acoustic module 21 includes spaced forward and rear coverplates 22, 23, as shown in FIG. 1, which form respective interfaces with the hydrophone layer 51 and the skirt baffle 41. Transverse and longitudinal spacer elements 24, 25 intersect to define a grid which extends between the coverplates 22, 23 to form a plurality of closed cells 26 which are isolated from the surrounding environment. The particular arrangement of coverplate 22, 23 and spacer element 24, 25 provides the acoustic module 21 with sufficient strength and rigidity so that hydrostatic forces do not appreciably deform and damage the array, but where the array retains the flexibility needed for mounting the module on slightly curved surfaces. The damping elements 27, which preferably have different dimensions to accomodate different incident center frequencies (fc), are disposed in the closed cells 26 and bonded to the interior surface of the outer coverplate 22 so that the acoustic signals reflected from the damping elements are coherent with and reinforce the incident signals at the hydrophone units 53. While the closed cells 26 in FIG. 2 are square shaped, other compatible cell configurations include cylindrical, rectangular and conical configurations. For example, cylindrical air cells may be constructed of cylindrical containers secured between spaced coverplate elements.

Each damping element 27, which is normally tuned for an incident acoustic signal of a particular center frequency (fn), includes an elastomeric mass or damping layer 28 that has a thickness of approximately $\lambda n/4$ and an inertial tuning mass 29 of steel or other materials, such as viscoelastic elments, which are bonded to the elastomeric layer 28. Preferably, the elastomeric layer 28 is selected of an appropriate material so that the modulus (E) of the material is equivalent to $16d^2f^2$, where:

d is the thickness of the elastomeric layer;

f is the frequency (fn) of the preferred incident acoustic signal; and $\rho$ is the density of the elastomeric layer.

In addition, the damping material 28 must possess sufficient "loss" characteristics to attenuate half-wavelength resonances while at the same time being insensitive to moderate temperature variations.

Examples of suitable elastomeric materials 28 include nitrile rubbers such as butadiene-acrylonitrile based compositions wherein the content, by weight percent, of the acrylonitrile should be between about 20% to about 47% and preferably between about 30% to about 38% of the composition. Such rubber materials are commercially available as Hycar 1014 and 1203 manufactured by B. F. Goodrich Co. and Paracril BLT and CLT as manufactured by Uniroyal, Inc. Particular examples of butadiene-acrylonitrile compositions are shown in the tables that follow. Other elastomers which are compatible elastomeric elements, when properly compounded, include natural rubber; propylene oxide rubber; epichlorohydrin rubber; butyl rubber; chlorobutyl and bromobutyl rubbers; ethylene acrylic rubber; and polynorbornenes. Somewhat less desirable compositions include neoprene; fluorocarbon; fluorosilicones; polyphosphazenes; polybutadienes; chlorosulfonated polyethylenes; styrene-butadiene rubber; and silicones.

NITRILE RUBBER FORMULATIONS

| Material | 1 | 2 | 3 | 4 | 5 | 6 | 7 |
|---|---|---|---|---|---|---|---|
| PARACRIL CLT | 100 | 100 | 100 | 100 | 100 | 100 | 100 |
| PHILBLACK N-550 | 70 | | | 20 | 20 | | |
| THERMAX | | 80 | 120 | | | | |
| IRON OXIDE | | | | 100 | 200 | | |
| QUSO WR 82 | | | | | | 30 | 50 |
| STEARIC ACID | 1 | 1 | 1 | 1 | 1 | 1 | 1 |
| PROTOX 166 | 5 | 5 | 5 | 5 | 5 | 5 | 5 |
| FYROL CEF | 5 | 5 | 5 | 5 | 5 | 5 | 5 |
| OCTIMINE | 1 | 1 | 1 | 1 | 1 | 1 | 1 |
| THIONEX | 0.5 | 0.5 | 0.5 | 0.5 | 0.5 | 0.5 | 0.5 |
| SULFUR | 1.5 | 1.5 | 1.5 | 1.5 | 1.5 | 1.5 | 1.5 |
| Total Parts By Weight | 184 | 194 | 234 | 234 | 334 | 144 | 164 |

| Material | 8 | 9 | 10 | 11 | 12 | 13 | 14 |
|---|---|---|---|---|---|---|---|
| PARACRIL CLT | 100 | 100 | 100 | 100 | 100 | 100 | 100 |
| PHILBLACK N-550 | 50 | 50 | 50 | 50 | 50 | 50 | 50 |
| PROTOX 166 | 5 | 5 | 5 | 5 | 5 | 5 | 5 |
| OCTIMINE | 2 | 2 | 2 | 2 | 2 | 2 | 2 |
| SARET 500 | | 5 | 10 | 20 | | | |
| SARET 515 | | | | | 5 | 10 | 20 |
| Di CUP 40 PEROXIDE | 4 | 4 | 4 | 4 | 4 | 4 | 4 |
| Total Parts By Weight | 161 | 166 | 171 | 181 | 166 | 171 | 181 |

DESCRIPTION OF VARIOUS COMPOUNDING MATERIALS

Elastomers:

Hycar 1034-60—acrylonitrile content 21%

Hycar 1203—70/30 blend of butadiene-acrylonitrile/polyvinyl chloride

Paracril BLT—acrylonitrile content 32%

Paracril CLT—acrylonitrile content 38%

Vulcanizing Agents—Peroxides:

Di Cup 40—Hercules, dicumyl peroxide, sp. gr. 1.607, peroxide content 39.5-41%

Saret 500+515-Sartomer, acrylic crosslinking agent, liquid polymerisable monomer, sp. gr. 1.08, B.p. 200° C.

Vul-Cup 40 KE—Hercules, α- α' - bis (t-butylperoxyl) diisopropylbenzene, sp. gr. 1.03, peroxide content 96-100%

Sulfur (Rubbermakers or Tire 21-12 MC-TP) vulcanizing agent, sp. gr. 2.07

Carbon Blacks:

Philblack N-330—Phillips Chemical, HAF, average particle size 30 mμ, surface area 81 $m^2/g$ Philblack N-358—Philips Chemical, SPF, averaged particle size 25 mμ, surface area 87 $m^2/g$ Regal 99 (n-440)—Cabot, FF, average particle size 43 mμ, surface area 60 $m^2/g$ Philblack N-550—Phillips Chemical, FEF, average particle size 41 mμ, surface area 43 $m^2/g$ Thermax—RT Venderbilt, MT, average particle size 320-472 mμ, surface area 8.2 $m^2/g$, density $kg/m^3$ Non-Black Fillers:

Andrez 8000AE, Anderson, Polystyrene resin

HiL-Sil 223-Harwick Chemical, precipitated, hydrated silica, sp. gr. 2.0, ultimate particle size 0.022 micron Iron Oxide—Black iron oxide, painter's grade Quso WR 82—Philadelphia Resins, Surface-treated silica pigment Titanium Dioxide—Whitener, medium grade Other Compounds:

Thionex—accelerator, for controlling the vulcanization

Fyrol CEF—plasticizer, for softing the compounds

Octamine—anti-oxidant, prevents oxidation reactions

Protox 166—activator, it reacts with the stearic acid to form a zinc stearate and it reacts with the curing agent.

In general, the viscoelastic properties of the rubbers, and, consequently, the attenuation properties can be manipulated by varying the composition of the rubber, the type and concentration of the fillers, and the type and concentration of the vulcanizing agent. For example, in rubber-based composites the modulus (E) generally increases and the "loss" characteristics decrease with increasing concentrations of carbon black. Also the modulus (E) of the material generally increases for a decrease in the particle size or an increase in the surface area of the carbon black. The modulus (E) of the composition is also often increased with increasing concentrations of non-black fillers such as iron oxide; hydrated silica; titanium oxide; silane-treated silica; as well as by increasing peroxide vulcanizing agents.

The utilization of an air backed elastomeric layer 28 as a one-quarter wavelength reflector behind the hydrophone is further enhanced by using the inertial fine tuning mass or tuning plate 29. The fine tuning of the elastomeric elements 27 for particular acoustic frequencies is achieved by selecting a tuning plate 29 of appropriate proportions, as described by the following mathematical expression:

$$\frac{Z_{in} = Z_s (Z_s + Z_r \tanh \gamma_r L_r i)}{Z_r + i Z_s \tanh \gamma_r L_r}$$

where $Z_{in}$=the input impedance of elastomeric layer or "spring" element 28, backed by inertial mass 29 which terminates at an air backed interface; $Z_s = i\omega m$=the impedance of inertial mass 29; $i=\sqrt{-1}$; $Z_r$=the characteristic impedance of elastomeric layer or "spring" element 28; $\gamma_r$=the complex propagation constant for layer 28; $L_r$=the length (thickness) of layer 28; $\omega$=the circular frequency $2\pi f$; and m=the mass per unit area of inertial mass 29. If the fine tuning element or tuning plate 29 is constructed of a viscoelastic material ($Z_v$), then $Z_s = Z_v \tanh \gamma_v L_v$, where the quantities having subscripts "v" correspond to those quantities having the subscript "r" in the above equation. By using an elastomeric element 28, which has a thickness of $\gamma_c/4$ for a particular center frequency $f_c$, and tuning plate 29, the hyperbolic tangent function increases to maximum values and the input impedance increases accordingly. The air contained in the closed cells 26 provides a pressure release for the elastomeric mass or spring element 28 so that the layer resonates in its Young's modulus fashion. The air contained in the closed cells 26 also provides the conditioning module 21 with a buoyancy factor so that the conditioning module 21 can be made neutrally buoyant at a predetermined operating depth.

Means for supporting the conditioning module 21 from the hull 13 of the vessel include a plurality of spaced struts 17 secured to the hull 13 and connected to the conditioning module 21. Vibration isolation elements 18 are provided at the joint between the struts 17 and the conditioning module 21 for reducing vibrations transmitted therebetween.

The skirt baffle 41, which is disposed between the conditioning module 21 and the hull 13 of the vessel, reduces the transmission of shipboard noise to the conditioning module 21 by the combined actions of attenuation, absorption, and reflection. A particular example of a skirt baffle 41 shown in FIG. 4 comprises a layer of an acoustic decoupling material 44 disposed between the high impedance stiff plates 45. The acoustic decoupling materials 44, which may be multi-cellular or substantially non-cellular, are selected from the various elastomers such as rubber, silicone elastomers, polyurethane, butyl rubbers, etc. The plates 45 are preferably formed of a rigid material such as glass reinforced plastics or polycarbonates. A second example of a skirt baffle construction is shown in the respective plan and cross-sectional views of FIGS. 5 and 6, wherein the decoupling material 44 is provided with a plurality of air cells 46, wherein the air cells 46 decrease the resultant effective impedance of the decoupling material 44.

The outer layer 51 of the sonar array, in which the hydrophone units 53 are embedded, is bonded to the exterior coverplate 22 of the conditioning module 21 so that the outer layer 51 and the conditioning module 21 are mounted on the hull 13 of the vessel as an integral unit. To allow the incident acoustic signals to reach the hydrophone units 53, the outer layer 51 should comprise a material which has an impedance that matches seawater. Examples of suitable materials include elastomers such as silicone, polyurethane, butyl rubber, and natural rubber, acrylic resins such as polymers of acrylic acid, methacrylic acid, and acrylonitriles, and epoxides of glycidyl ethers of phenols.

Obviously many modifications and variations of the present invention are possible in light of the above teachings. For example, the damping elements 27 may be formed of a plurality of layers of viscoelastic materials having different moduli of elasticity and different acoustic characteristics. It is therefore to be understood that within the scope of the appended claims the invention may be practiced otherwise than as specifically described.

What is claimed is:

1. An acoustic array for application to submerged hull surfaces comprises:

an acoustic baffle for attachment to the hull to reduce the transmission of shipboard noise;

an acoustic conditioning module connected to said acoustic baffle for coherently reflecting the incident acoustic signal so that the reflected acoustic signals reinforce the incident acoustic signals; said conditioning module comprises inner and outer coverplates, a plurality of spacer elements extending between said coverplates to form a plurality of closed chambers therebetween, and tuned damping elements positioned in said chambers and secured to said outer coverplate; said inner coverplate connected to said acoustic baffle; and said damping elements include an elastomeric damping layer secured to said outer coverplate and an inertial mass secured to said elastomeric damping layer and spaced from said inner coverplate; and an outer layer connected to said outer coverplate and containing a plurality of hydrophone elements embedded therein, said outer layer formed of a material having an impedance which substantially matches the impedance of seawater.

2. The acoustic array according to claim 1, wherein each of said damping elements is constructed to coherently reflect and enhance incident acoustic frequencies of a different predetermined center frequency; and wherein said elastomeric damping layer has a modulus of elasticity which is equivalent to $16d^2f^2\rho$, where d is the thickness of said elastomeric damping layer, f is the frequency of predetermined incident acoustic frequency; and $\rho$ is the density of said elastomeric damping layer.

3. The acoustic array according to claim 1, wherein the acoustic impedance of said elastomeric damping layer is equivalent to $(Z_s(Z_s=iZ_r \tanh \gamma_r L_r))/(Z_r+iZ_s \tanh \gamma_r L_r)$; where $Z_s=i\omega m$, the impedance of said inertial mass, i is equivalent to $\sqrt{-1}$, $Z_r$ is the impedance of said elastomeric damping layer; $\gamma_r$ is the complex propagation constant for said elastomeric damping layer, $L_r$ is the thickness of said elastomeric damping layer, $\omega$ is the angular incident frequency $2\pi f$, and m is the mass per unit area of said inertial mass layer.

4. The acoustic array according to claim 1, wherein said elastomeric damping layer is formed of materials selected from the group of nitrile rubbers, natural rubbers, propylene oxide rubber, epichlorohydrin rubber, butyl rubber, chlorobutyl and bromobutyl rubbers, ethylene acrylic rubber, and polynorbornenes; and said inertial mass is formed of a metallic material.

5. The acoustic array according to claim 1, wherein said elastomeric damping layer and said inertial mass are formed of elastomeric materials having different modulus of elasticity.

6. The acoustic array according to claim 5, wherein said acoustic baffle comprises an elastomeric layer positioned between thin layers of fiber reinforced resin materials.

* * * * *